US011926944B2

(12) United States Patent
Ishikawa et al.

(10) Patent No.: US 11,926,944 B2
(45) Date of Patent: Mar. 12, 2024

(54) LOWER THREAD WINDING DEVICE

(71) Applicant: JANOME Corporation, Hachioji (JP)

(72) Inventors: Muneyuki Ishikawa, Hachioji (JP); Hiroki Shiratsuchi, Hachioji (JP)

(73) Assignee: JANOME Corporation, Hachioji (JP)

( * ) Notice: Subject to any disclaimer, the term of this patent is extended or adjusted under 35 U.S.C. 154(b) by 135 days.

(21) Appl. No.: 17/826,161

(22) Filed: May 27, 2022

(65) Prior Publication Data

US 2022/0411980 A1 Dec. 29, 2022

(30) Foreign Application Priority Data

Jun. 23, 2021 (JP) ..... 2021-103706

(51) Int. Cl.
*D05B 57/26* (2006.01)
*D05B 57/28* (2006.01)
*D05B 59/00* (2006.01)

(52) U.S. Cl.
CPC ..... *D05B 57/265* (2013.01); *D05B 57/28* (2013.01); *D05B 59/00* (2013.01)

(58) Field of Classification Search
CPC ..... D05B 57/265; D05B 57/26; D05B 57/28; D05B 57/00; D05B 57/04; D05B 57/12; D05B 57/14; D05B 57/16; D05B 57/18; D05B 57/20; D05B 59/00
See application file for complete search history.

(56) References Cited

U.S. PATENT DOCUMENTS 2,514,423 A * 7/1950 Slinkard ..... B65H 54/71 242/474.8
3,096,736 A * 7/1963 Johnson ..... D05B 59/00 112/181
4,646,982 A * 3/1987 Spring ..... D05B 59/00 242/484.8
4,934,292 A * 6/1990 Mardix ..... D05B 51/00 112/273
5,816,512 A * 10/1998 Nakashima ..... D05B 59/00 242/484.7

(Continued)

FOREIGN PATENT DOCUMENTS

JP 2007-252414 A 10/2007
JP 2012-139329 A 7/2012
TW 202208713 A 3/2022

*Primary Examiner* — Ismael Izaguirre
(74) *Attorney, Agent, or Firm* — Yokol & Co., U.S.A.; Toshiyuki Yokoi

(57) ABSTRACT

In thread cutting mechanism portions of a lower thread winding device, two groove portions of an inner threading groove portion and an outer threading groove portion are formed on a holder. In the inner threading groove portion, one end portion is opened to one of an intersecting direction intersecting with a radial direction of the holder at an outer peripheral portion of the holder and another end portion is located at an inner side of a small-diameter bobbin in the radial direction. The outer threading groove portion is located at an outer side of the inner threading groove portion in the radial direction of the holder. In the outer threading groove portion, one end portion is communicated with the inner threading groove portion and located at the outer side of a large-diameter bobbin in the radial direction and another end portion is located at the inner side of the large-diameter bobbin in the radial direction.

5 Claims, 7 Drawing Sheets

(56) References Cited

U.S. PATENT DOCUMENTS

| | | | | |
|---|---|---|---|---|
| 6,640,734 | B2 * | 11/2003 | Hayashi | D05B 3/02 112/279 |
| 2017/0022644 | A1 * | 1/2017 | Iizuka | D05B 57/26 |
| 2022/0064833 | A1 | 3/2022 | Chen et al. | |

* cited by examiner

LOWER THREAD WINDING DEVICE

CROSS-REFERENCES TO RELATED APPLICATIONS

This patent specification is based on Japanese patent application, No. 2021-103706 filed on Jun. 23, 2021 in the Japan Patent Office, the entire contents of which are incorporated by reference herein.

BACKGROUND OF THE INVENTION

1. Field of the Invention

The present invention is related to a lower thread winding device.

2. Description of the Related Art

A lower thread winding device disclosed in Patent Document 1 below is configured to include a motor, a shaft portion connected to a motor shaft of the motor so as to be rotatable with the motor shaft. A holding shaft (thread winding shaft) and a flange portion (holder) are provided on an upper end portion of the shaft portion. When the motor is driven in a state that a bobbin is attached to the holding shaft and placed on the flange portion, the bobbin is rotated together with the holding shaft and a lower thread is wound around the bobbin.

In addition, a threading groove is formed on the flange portion and a thread cutting blade is provided at an end of the threading groove. Because of this, after the lower thread is wound around the bobbin, the lower thread extended from the bobbin is inserted between a flange of the bobbin and the flange portion and inserted into the threading groove. Thus, the lower thread can be cut by the thread cutting blade. Consequently, the length of one end portion of the lower thread extended from the bobbin can be constant after the thread cutting process while one end portion of the lower thread is held between the flange of the bobbin and the flange portion.

[Patent Document 1] Japanese Unexamined Patent Application Publication No. 2007-252414

BRIEF SUMMARY OF THE INVENTION

Here, the outer diameter of the flange of the bobbin may be different depending on the bobbin. For example, if the position of the threading groove is set corresponding to the bobbin having a smaller diameter, the length of one end portion of the lower thread may become extremely long after the thread cutting process of the lower thread wound around the bobbin having a larger diameter. This may adversely affect the sewing operation. On the other hand, for example, if the position of the threading groove is set corresponding to the bobbin having a larger diameter, one end of the lower thread may not be held by the flange of the bobbin and the flange portion when the bobbin having a smaller diameter is attached to the holding shaft. As described above, it is preferable that the lower thread winding device has the structure capable of performing the thread cutting process well for the lower thread wound around the bobbins having different outer diameters.

The present invention provides a lower thread winding device capable of performing the thread cutting process well for the lower thread wound around the bobbins having different outer diameters.

One or more embodiments of the present invention propose a lower thread winding device, including: a thread winding shaft to which a small-diameter bobbin and a large-diameter bobbin having a larger diameter than the small-diameter bobbin can be attached; a holder which is configured to be integrally rotated with the thread winding shaft, the holder being formed in a disk shape so that a plate thickness direction of the holder is directed in an axial direction of the thread winding shaft, the small-diameter bobbin or the large-diameter bobbin attached to the thread winding shaft being configured to be placed on the holder; an inner groove portion which is formed on the holder so as to be extended in an intersecting direction intersecting with a radial direction of the holder when viewed from the axial direction, one end portion of the inner groove portion being opened to one of the intersecting direction at an outer peripheral portion of the holder, another end portion of the inner groove portion being located at an inner side of the small-diameter bobbin attached to the thread winding shaft in the radial direction; an outer groove portion which is formed on the holder so as to be extended in the intersecting direction at an outer side of the inner groove portion in the radial direction of the holder, one end portion of the outer groove portion being curved toward the inner groove portion, communicated with the inner groove portion and located at the outer side of the large-diameter bobbin attached to the thread winding shaft in the radial direction, another end portion of the outer groove portion being located at the inner side of the large-diameter bobbin in the radial direction; a first blade portion provided on the holder so as to be exposed to the another end portion of the inner groove portion; and a second blade portion provided on the holder so as to be exposed to the another end portion of the outer groove portion.

One or more embodiments of the present invention propose the lower thread winding device, wherein the first blade portion and the second blade portion are formed of a single blade member.

One or more embodiments of the present invention propose the lower thread winding device, wherein the holder includes an inner guide portion for partitioning the inner groove portion and the outer groove portion from each other, the inner guide portion is protruded from the holder toward the one of the intersecting direction, and a tip end portion of the inner guide portion is located at the outer side of the small-diameter bobbin attached to the thread winding shaft in the radial direction and located at the inner side of the large-diameter bobbin in the radial direction when viewed from the axial direction.

One or more embodiments of the present invention propose the lower thread winding device, wherein the holder includes an outer guide portion located at the outer side of the outer groove portion in the radial direction of the holder so that the outer guide portion forms the outer peripheral portion of the holder, the outer guide portion is extended from the holder toward the one of the intersecting direction, and a thread wound around the small-diameter bobbin and entered below the outer guide portion is guided by the inner groove portion.

One or more embodiments of the present invention propose the lower thread winding device, wherein a lower surface of the tip end portion of the inner guide portion is provided with an inner guide surface inclined upward toward the tip end portion of the inner guide portion, and the lower surface of the tip end portion of the outer guide portion is provided with an outer guide surface inclined upward toward the tip end portion of the outer guide portion.

One or more embodiments of the present invention have an effect that the thread cutting process can be performed well for the lower thread wound around the bobbins having different outer diameters.

DETAILED DESCRIPTION OF THE INVENTION

Hereafter, a lower thread winding device 10 concerning an embodiment of the present invention will be explained with reference to the drawings. The lower thread winding device 10 forms a part of a not-illustrated sewing machine and is a device for winding the lower thread around the bobbin attached to the lower thread winding device 10. In addition, the lower thread winding device 10 is configured so that the lower thread can be wound around two kinds of bobbins having different outer diameters from each other. In the following explanation, two kinds of bobbins will be explained in advance and then the lower thread winding device 10 will be explained.

(Bobbin)

Figure 7B:
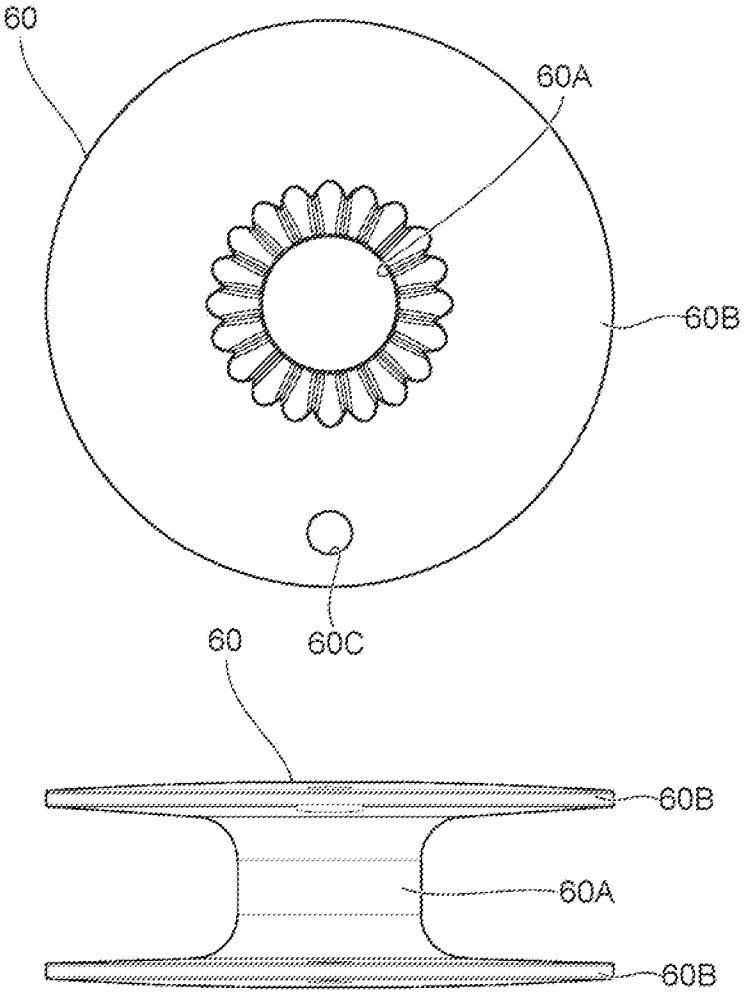
FIG. 7B is a two-planes drawing showing the large-diameter bobbin attached to the lower thread winding device shown in FIG. 1.
Figure 7A:
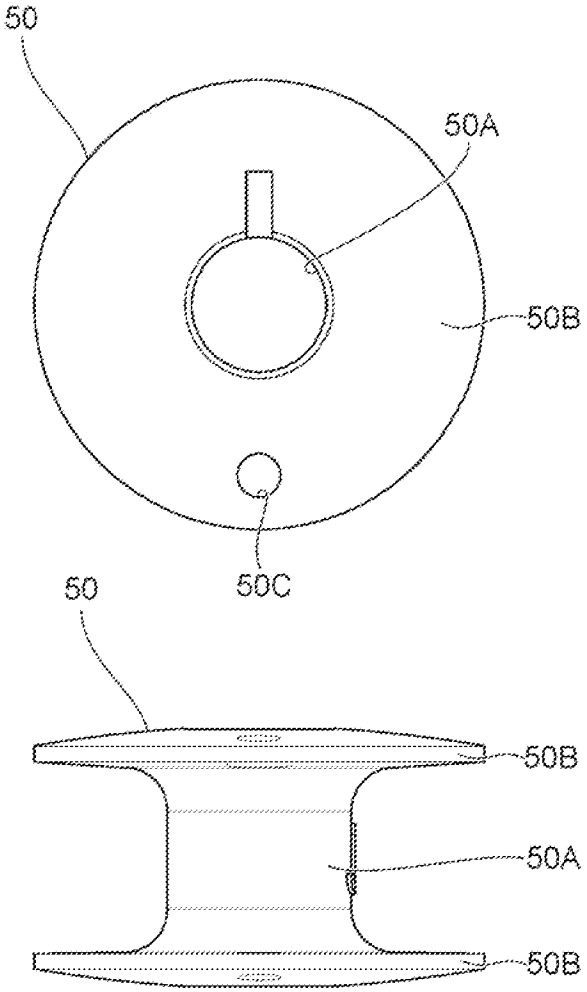
FIG. 7A is a two-planes drawing showing the small-diameter bobbin attached to the lower thread winding device shown in FIG. 1.

As shown in FIG. 7A, a small-diameter bobbin 50 is configured to include a core portion 50A having a cylindrical shape and a pair of flange portions 50B protruded outward from both end portions of the core portion 50A in an axial direction of the core portion 50A.

A threading hole 50C having a circular shape is formed penetrating an outer peripheral portion of each of the flange portions 50B.

As shown in FIG. 7B, similar to the small-diameter bobbin 50, a large-diameter bobbin 60 is configured to include a core portion 60A having a cylindrical shape and a pair of flange portions 60B protruded outward from both end portions of the core portion 60A in an axial direction of the core portion 60A. The diameter of the flange portions 60B of the large-diameter bobbin 60 is specified to be larger than the diameter of the flange portions 50B of the small-diameter bobbin 50. A threading hole 60C having a circular shape is formed penetrating an outer peripheral portion of each of the flange portions 60B. In addition, the axial length of the large-diameter bobbin 60 is specified to be shorter than the axial length of the small-diameter bobbin 50.

(Lower Thread Winding Device 10)

Figure 1:
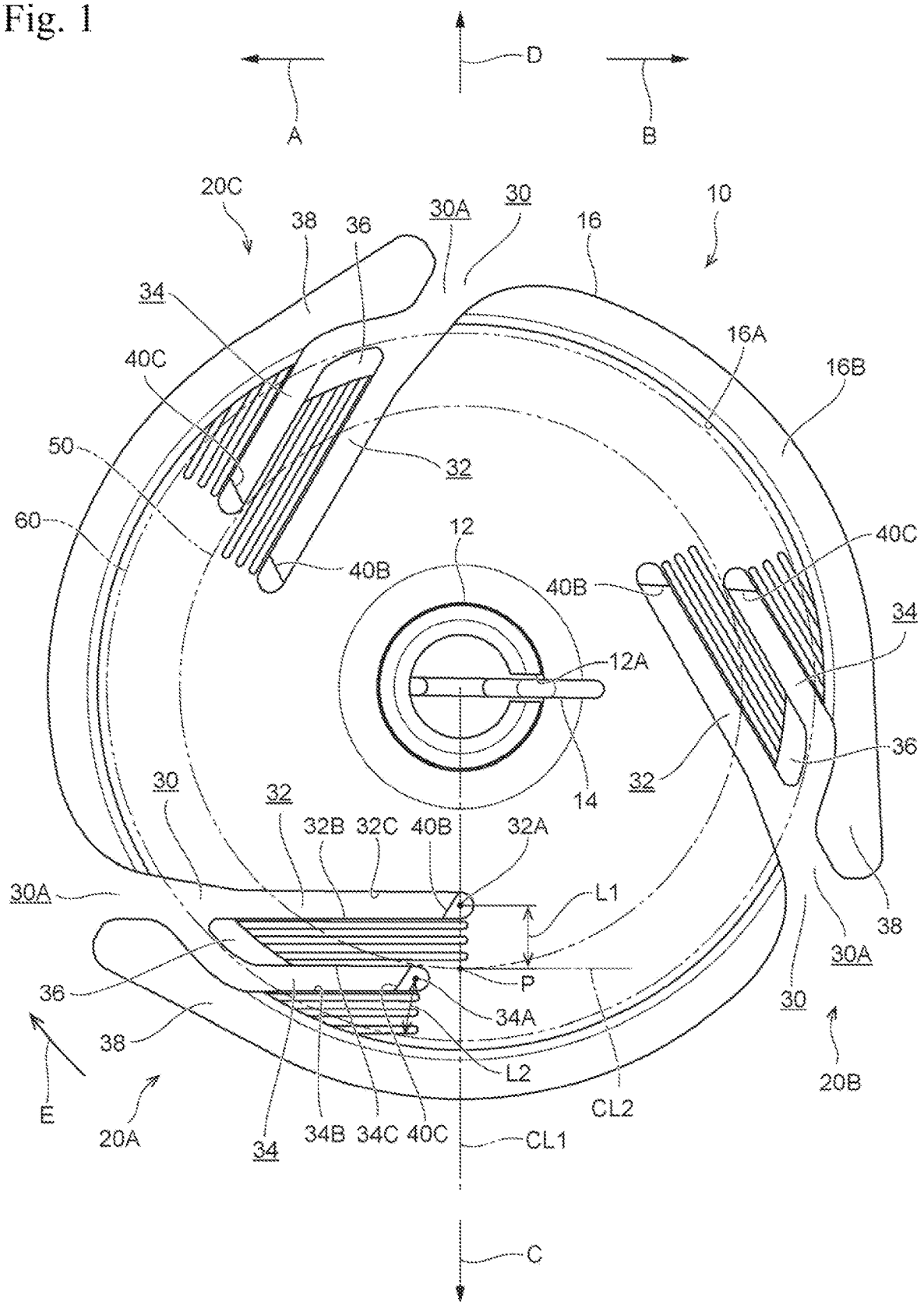
FIG. 1 is a plan view showing a lower thread winding device concerning an embodiment of the present invention viewed from the above.
Figure 2:
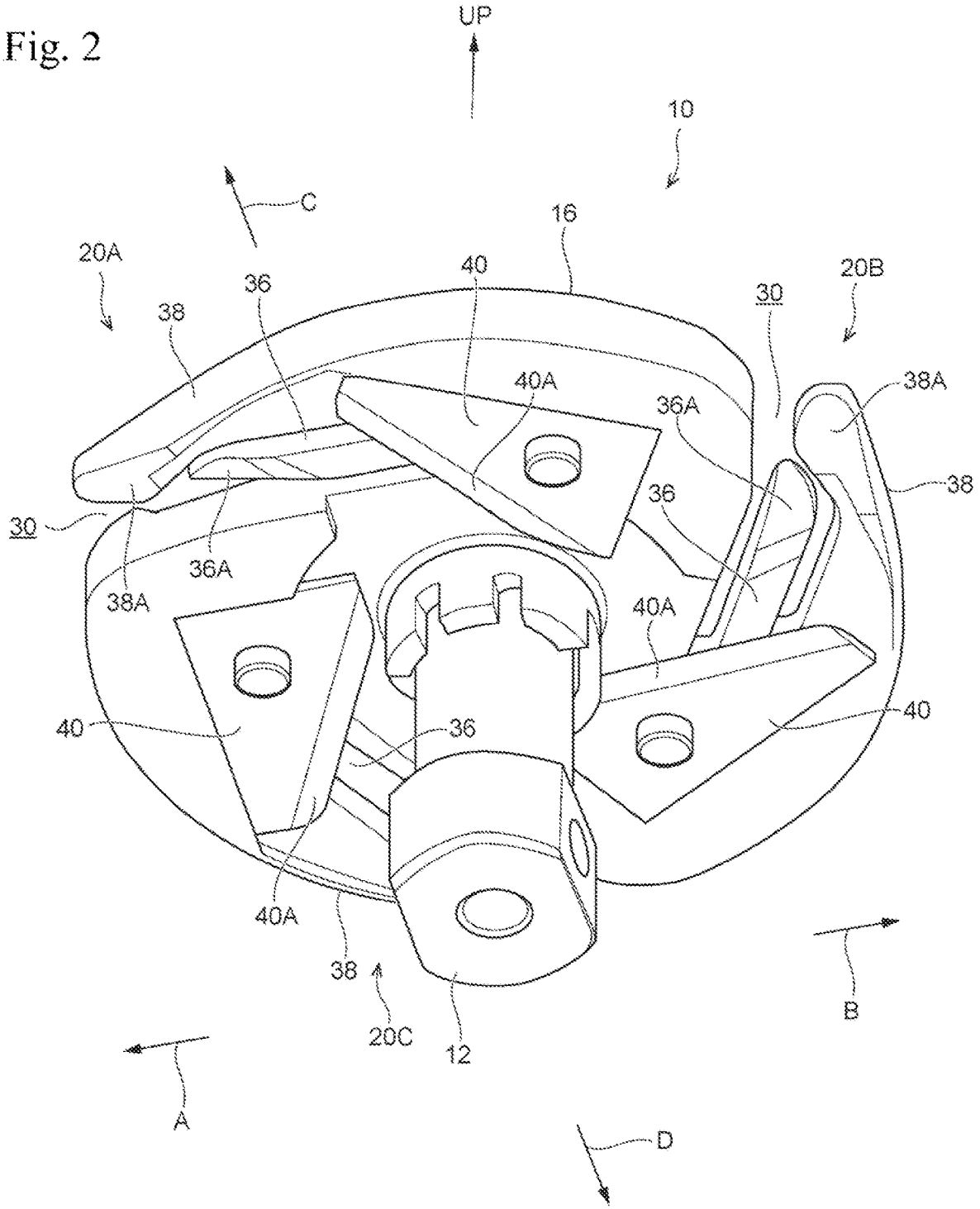
FIG. 2 is a perspective view of the lower thread winding device shown in FIG. 1 viewed from the below.

As shown in FIG. 1 to FIG. 6, the lower thread winding device 10 is configured to include a thread winding shaft 12 and a holder 16. Note that the arrow mark UP shown in FIG. 2 shows an upper direction of the lower thread winding device 10. In the following explanation, the direction orthogonal to the vertical (up-down) direction is referred to as the first direction (the direction of the arrow mark A and arrow mark B shown in FIG. 1) and the direction orthogonal to the vertical direction and the first direction is referred to as the second direction (the direction of the arrow mark C and arrow mark D shown in FIG. 1).

(Thread Winding Shaft 12)

The thread winding shaft 12 is formed in an approximately cylindrical shape in a state that the axial direction of the thread winding shaft 12 is directed in the vertical direction. An output shaft of a not-illustrated thread winding motor is fitted into a lower end portion of the thread winding shaft 12 from the below. Thus, the thread winding shaft 12 is connected to the thread winding motor so as to be integrally rotated with the thread winding motor. A slit 12A extending in the vertical direction is formed on the upper end portion of the thread winding shaft 12. The slit 12A penetrates through the thread winding shaft 12 in the radial direction and opens to the upper side.

A pressing pin 14 is inserted into the inside of the thread winding shaft 12. The pressing pin 14 is configured as a bar spring having a circular cross-section. A base end portion of the pressing pin 14 is locked to the thread winding shaft 12 in the thread winding shaft 12. A tip end portion of the pressing pin 14 is protruded from the slit 12A outward in the radial direction of the thread winding shaft 12. The pressing pin 14 is configured to be elastically deformable so as to be displaced in the radial direction of the thread winding shaft 12.

(Holder 16)

As shown in FIG. 1 and FIG. 2, the holder 16 is formed in an approximately disk shape so that the plate thickness direction of the holder 16 is directed in the vertical direction. The holder 16 is connected to the thread winding shaft 12 in a state that the thread winding shaft 12 is protruded upward from the center portion of the holder 16 so that the holder 16 is integrally rotated with the thread winding shaft 12 and the holder 16 is moved relatively to the thread winding shaft 12 in the vertical direction. In addition, when the small-diameter bobbin 50 or the large-diameter bobbin 60 is attached to the lower thread winding device 10, the core portion 50A of the small-diameter bobbin 50 or the core portion 60A of the large-diameter bobbin 60 is attached to the thread winding shaft 12 from the above and the small-diameter bobbin 50 or the large-diameter bobbin 60 is placed on the holder 16. Furthermore, the holder 16 is energized upward by a not-illustrated holder energizing spring. In a state that the small-diameter bobbin 50 or the large-diameter bobbin 60 is attached to the lower thread winding device 10, the small-diameter bobbin 50 or the large-diameter bobbin 60 is sandwiched in the vertical direction by the tip end portion of the pressing pin 14 and the holder 16 to hold the small-diameter bobbin 50 or the large-diameter bobbin 60. Namely, the holder 16 is configured as a receiving member for receiving the small-diameter bobbin 50 or the large-diameter bobbin 60 attached to the thread winding shaft 12 from the below.

A receiving recessed portion 16A opened upward is formed on an upper surface of the holder 16. A bottom surface of the receiving recessed portion 16A is configured as a receiving surface for receiving the small-diameter bobbin 50 or the large-diameter bobbin 60. The receiving recessed portion 16A is formed in a circular shape in a plan view. The diameter of the receiving recessed portion 16A is specified to be larger than the diameter of the large-diameter bobbin 60. Consequently, a surrounding portion 16B is formed on an outer peripheral portion of the holder 16 so that the surrounding portion 16B is protruded upward from the receiving surface of the receiving recessed portion 16A and extended in a circumferential direction.

In addition, the holder 16 includes a plurality (three in the present embodiment) of thread cutting mechanism portions 20A, 20B, 20C. The thread cutting mechanism portions 20A, 20B, 20C are configured as a mechanism portion for performing a thread cutting process of the lower thread preliminarily wound around the small-diameter bobbin 50 or the large-diameter bobbin 60 manually by an operator. Here, the thread cutting process is performed as a preprocessing before winding the lower thread around the small-diameter bobbin 50 or the large-diameter bobbin 60 by the lower thread winding device 10. The thread cutting mechanism portion 20A is provided on an outer peripheral portion of the holder 16 at one side (direction of arrow A in FIG. 1) of the first direction and one side (direction of arrow C in FIG. 1) in the second direction with respect to the center of the holder 16. The thread cutting mechanism portions 20A, 20B, 20C located at three positions are arranged at equal intervals (each 120 degrees) in the circumferential direction of the holder 16. The thread cutting mechanism portions 20A, 20B, 20C are configured similarly. Here after, the configuration of the thread cutting mechanism portions 20A, 20B, 20C will be explained using the thread cutting mechanism portion 20A.

The thread cutting mechanism portion 20A is configured to include a threading groove 30 formed on the holder 16 and a thread cutting blade 40 provided on the holder 16 as a blade member.

(Threading Groove 30)

The threading groove 30 includes an inner threading groove portion 32 as an inner groove portion and an outer threading groove portion 34 as an outer groove portion. Thus, the threading groove 30 is formed in a forked groove divided into two at the outer peripheral portion of the holder 16.

(Inner Threading Groove Portion 32)

The inner threading groove portion 32 is formed in a groove shape extended in the first direction (direction orthogonal to the radial direction of the holder 16) in a plan view and penetrated in the vertical direction. Consequently, the first direction corresponds to an intersecting direction of the present invention in the thread cutting mechanism portion 20A. One end portion of the inner threading groove portion 32 is opened to one (one side) of the first direction at the outer peripheral portion of the holder 16. In addition, the one end portion of the inner threading groove portion 32 is slightly inclined to the other (another side) of the second direction toward the one of the first direction.

In addition, another end portion 32A of the inner threading groove portion 32 is arranged (located) at one side in the second direction (outside in radial direction) with respect to a center portion of the holder 16. Furthermore, the another end portion 32A of the inner threading groove portion 32 is arranged (located) at an inner side of an outer shape of the small-diameter bobbin 50 attached to the thread winding shaft 12 in the radial direction in a plan view. Specifically, an aerial line passing through a center of the holder 16 and aligned along the second direction (radial direction of the holder 16) is specified as a reference line CL1. In addition, when a point where the reference line CL1 and the outer shape of the small-diameter bobbin 50 are intersected is specified as an intersection point P, a tangent line CL2 at the intersection point P is extended along the first direction in a plan view. Furthermore, the position displacing (offsetting) the tangent line CL2 at the intersection point P to the other of the second direction (inside in the radial direction) by a predetermined distance L1 is specified as the another end portion 32A of the inner threading groove portion 32. Thus, the inner threading groove portion 32 is extended from the another end portion 32A to one of the first direction which is the extending direction of the tangent line CL2. In other words, the another end portion 32A of the inner threading groove portion 32 is the position displaced to the inside in the radial direction by the predetermined distance L1 with respect to an arbitrary point (intersection point P in the above described example) on the outer shape of the small-diameter bobbin 50 in a plan view. The inner threading groove portion 32 is extended from the another end portion 32A as a starting point so as to be parallel with the tangent line (tangent line CL2 in the above described example) at an arbitrary point (intersection point P in the above described example) on the outer shape of the small-diameter bobbin 50 in a plan view. Consequently, the another end portion of the inner threading groove portion 32 is overlapped with the small-diameter bobbin 50 in a plan view. In addition, an inner peripheral surface of the inner threading groove portion 32 located at the one of the second direction is configured as an outside inner peripheral surface 32B and an inner peripheral surface of the inner threading groove portion 32 at the other of the second direction is configured as an inside inner peripheral surface 32C.

(Outer Threading Groove Portion 34)

The outer threading groove portion 34 is formed in a groove shape extended in the first direction at one of the second direction of the inner threading groove portion 32 and penetrated in the vertical direction. The groove width of the outer threading groove portion 34 is approximately same as the groove width of the inner threading groove portion 32. In addition, the one end portion of the outer threading groove portion 34 is inclined to the other of the second direction toward one of the first direction and communicated with the one end portion of the inner threading groove portion 32. More in detail, the one end portion of the outer threading groove portion 34 is arranged neighboring to the inside of the surrounding portion 16B in the radial direction and extended from the outer threading groove portion 34 to the one side (direction of the arrow mark E in FIG. 1) in the peripheral direction of the holder 16. By the above described configuration, the open end portion of the inner threading groove portion 32 is configured as an inlet portion 30A of the threading groove 30. Thus, the threading groove 30 is divided into two at the other of the first direction of the inlet portion 30A. An inner peripheral surface of the outer threading groove portion 34 located at one of the second direction is configured as an outside inner peripheral surface 34B and an inner peripheral surface of the outer threading groove portion 34 located at the other of the second direction is configured as an inside inner peripheral surface 34C.

In addition, another end portion 34A of the outer threading groove portion 34 is arranged at one of the first direction and one of the second direction with respect to the another end portion 32A of the inner threading groove portion 32 and arranged at the inside of the outer shape of the large-diameter bobbin 60 attached to the thread winding shaft 12 in the radial direction in a plan view. Specifically, in the radial direction of the holder 16, the position of the another end portion 34A of the outer threading groove portion 34 is specified so that a distance L2 between the outer shape of the large-diameter bobbin 60 and the another end portion 34A of the outer threading groove portion 34 is approximately same as the above described predetermined distance L1. Consequently, the another end portion of the outer threading groove portion 34 is overlapped with the large-diameter bobbin 60 in a plan view. In the present embodiment, the length of the outer threading groove portion 34 is specified to be shorter than the length of the inner threading groove portion 32. In addition, the inside inner peripheral surface 34C is arranged at a slightly inside of the outer shape of the large-diameter bobbin 60 in the radial direction at the one end portion of the outer threading groove portion 34. Accordingly, almost entire part of the one end portion of the outer threading groove portion 34 is arranged at an outer side of the large-diameter bobbin 60 in the radial direction.

A portion located between the inner threading groove portion 32 and the outer threading groove portion 34 in the holder 16 is configured as an inner guide portion 36. Namely, the inner guide portion 36 is extended in one of the first direction from a base end portion which is a portion located between another end portion 32A of the inner threading groove portion 32 and the another end portion 34A of the outer threading groove portion 34. A tip end portion of the inner guide portion 36 is protruded to one of the first direction compared to the small-diameter bobbin 50. In addition, since the tip end portion of the inner guide portion 36 forms the inside inner peripheral surface 34C at the one end portion of the outer threading groove portion 34, the tip end portion of the inner guide portion 36 is formed in an arc shape along the circumferential direction of the holder 16 in a plan view. As described above, the tip end surface of the inner guide portion 36 is arranged slightly inside of the outer shape of the large-diameter bobbin 60 in the radial direction in a plan view. Namely, when the large-diameter bobbin 60 is attached, the entire inner guide portion 36 is specified to be hidden by the flange portions 60B of the large-diameter bobbin 60 in a plan view. In addition, an inner guide surface 36A (shown in FIG. 2) is formed on the lower surface of the tip end portion of the inner guide portion 36, and the inner guide surface 36A is inclined upward toward the tip end portion of the inner guide portion 36.

Furthermore, a portion of the holder 16 located at the outer side of the outer threading groove portion 34 is configured as an outer guide portion 38. Namely, the outer guide portion 38 is extended to one of the first direction from a base end portion which is a portion located at the outer side of the another end portion 34A of the outer threading groove portion 34. An outer guide surface 38A (shown in FIG. 2) is formed on the lower surface of the tip end portion of the outer guide portion 38, and the outer guide surface 38A is inclined upward toward the tip end portion of the outer guide portion 38. Although the details will be described later, the inner guide surface 36A is configured so that the lower thread is not caught by the tip end portion of the inner guide portion 36 when the thread cutting process is performed for the lower thread wound around the small-diameter bobbin 50. In addition, the tip end portion of the outer guide portion 38 is configured so as not to be protruded to the side of the inner threading groove portion 32 with respect to the outside inner peripheral surface 32B of the inner threading groove portion 32 viewed from one of the first direction. In the present embodiment, the tip end portion of the outer guide portion 38 is formed so as to be arranged on the same surface as the outside inner peripheral surface 32B of the inner threading groove portion 32 viewed from one of the first direction.

(Thread Cutting Blade 40)

The thread cutting blade 40 is formed in an approximately trapezoidal plate shape so that the plate thickness direction of thread cutting blade 40 is directed in the vertical direction. The thread cutting blade 40 is arranged below the holder 16 and fixed to the holder 16. A blade portion 40A is formed on the outer peripheral portion of the thread cutting blade 40. A part of the blade portion 40A is arranged to be exposed to the inside of the another end portion 32A of the inner threading groove portion 32 and the another end portion 34A of the outer threading groove portion 34 in a plan view. The exposed portion of the blade portion 40A exposed to the another end portion 32A of the inner threading groove portion 32 is configured as a first blade portion 40B (shown in FIG. 1). The exposed portion of the blade portion 40A exposed to the another end portion 34A of the outer threading groove portion 34 is configured as a second blade portion 40C (shown in FIG. 1).

(Operation and Effect)

Then, the operation and effect of the present embodiment will be explained while explaining the thread cutting process of a lower thread T for winding the lower thread T around the small-diameter bobbin 50 or the large-diameter bobbin 60 using the thread cutting mechanism portion 20A.

(Thread Cutting Process of Lower Thread T for Winding Lower Thread T Around Small-Diameter Bobbin 50)

When the lower thread T is wound around the small-diameter bobbin 50 by the lower thread winding device 10, first, one end portion (tip end portion) of the lower thread T extended from a thread bobbin (not-illustrated) of a sewing machine is wound around the core portion 50A of the small-diameter bobbin 50 manually by an operator. Then, the thread cutting process is performed for one end portion of the lower thread T extended from the core portion 50A using the thread cutting mechanism portion 20A.

Specifically, the one end portion of the lower thread T extended from the core portion 50A of the small-diameter bobbin 50 is inserted into the threading groove 30 from the inlet portion 30A of the threading groove 30 of the holder 16. More specifically, the portion of the lower thread T extended from an outer peripheral edge portion of the flange portions 50B of the small-diameter bobbin 50 is inserted into the inlet portion 30A of the threading groove 30.

Figure 3B:
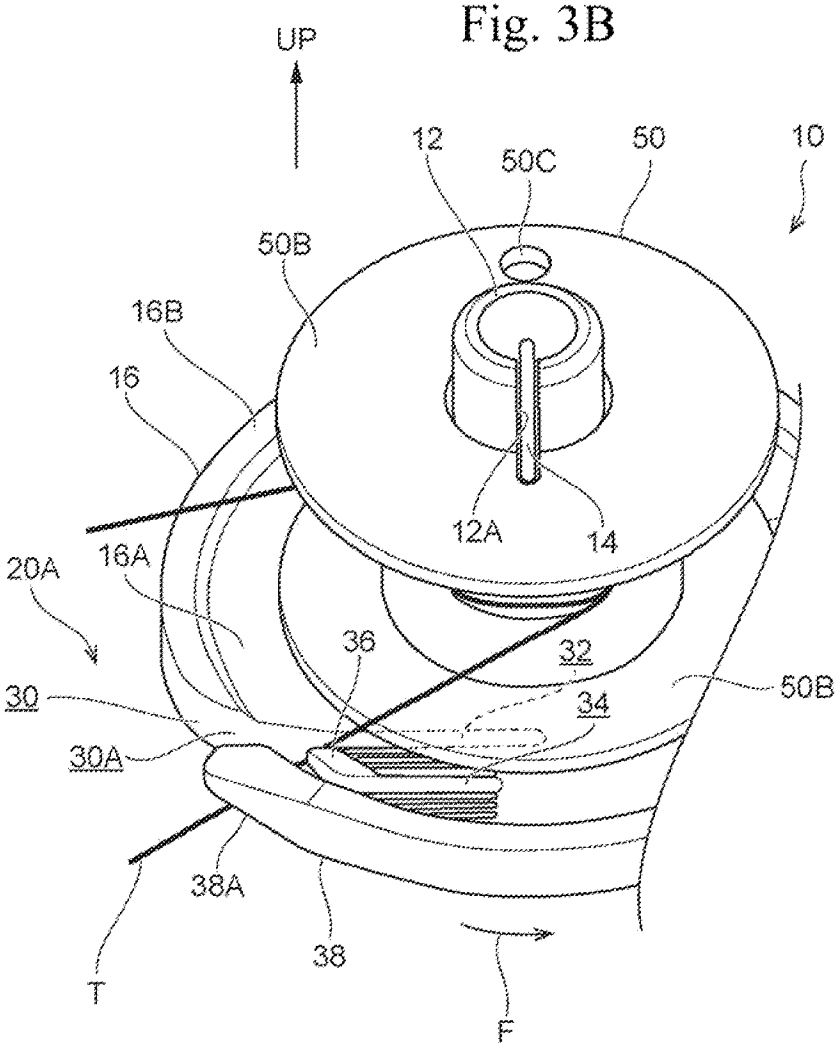
FIG. 3B is a perspective view of the initial state shown in FIG. 3A viewed from another position.
Figure 3A:
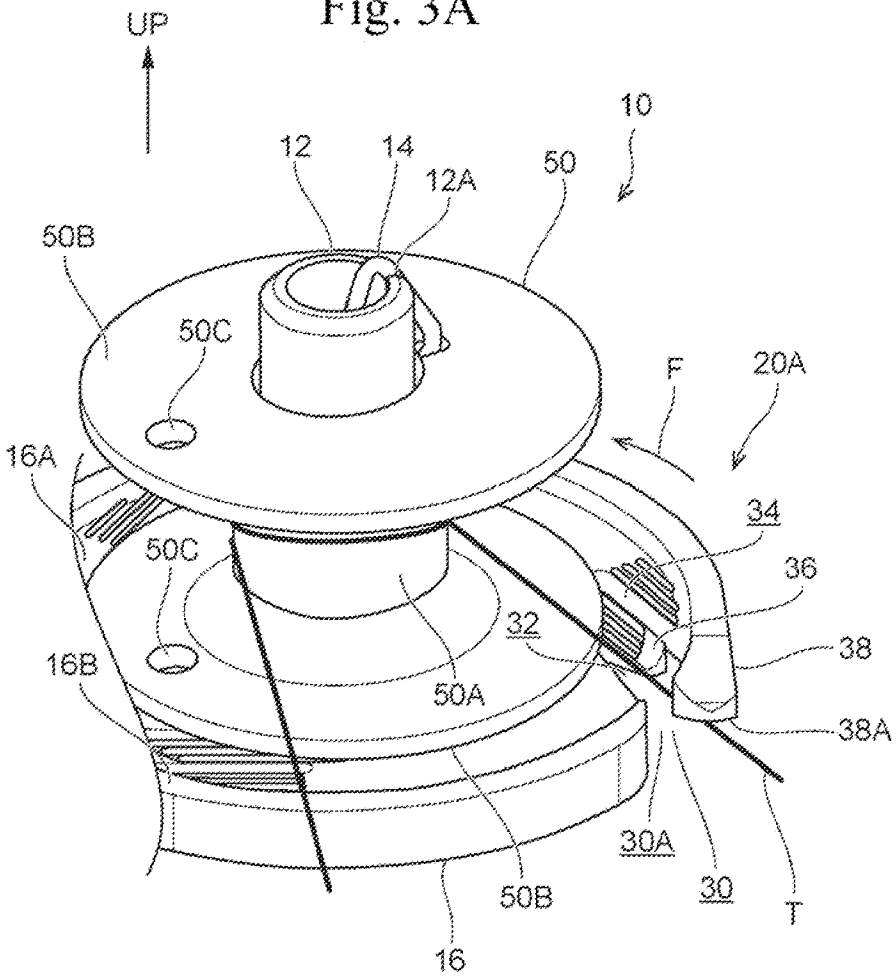
FIG. 3A is a perspective view showing an initial state of a thread cutting process of a lower thread wound around a small-diameter bobbin.
Figure 4:
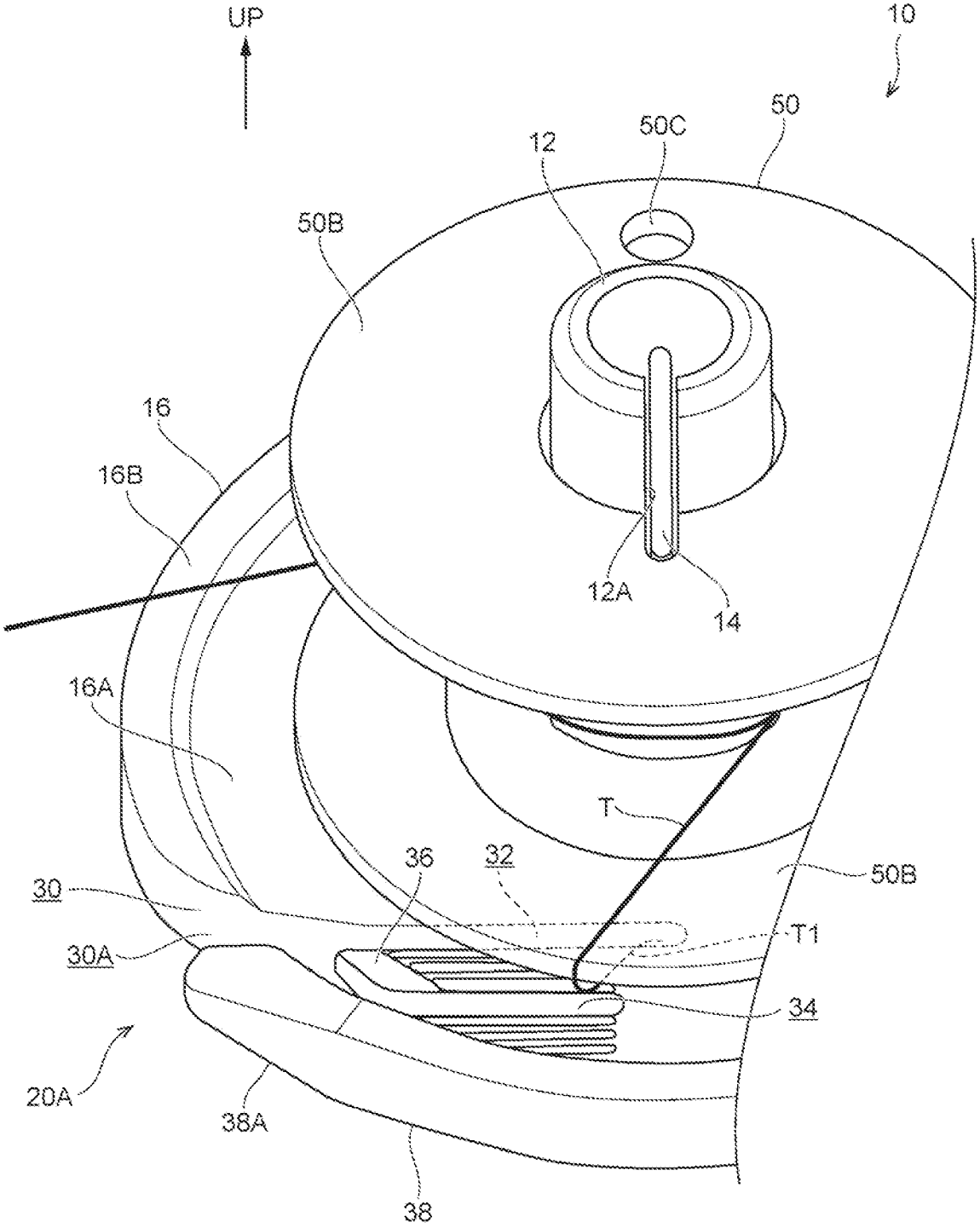
FIG. 4 is a perspective view showing a finished state of the thread cutting process of the lower thread wound around the small-diameter bobbin.

As shown in FIGS. 3A and 3B, the tip end portion of the one end portion of the lower thread T is pulled toward the other side (direction of the arrow mark F in FIGS. 3A and 3B) in the peripheral direction of the holder 16 from the above described state. Thus, the lower thread T is guided below the tip end portion of the outer guide portion 38 by the outer guide surface 38A of the outer guide portion 38. At this time, the portion of the lower thread T extended from the flange portions 50B of the small-diameter bobbin 50 is arranged near the tip end portion of the inner guide portion 36. When the tip end portion of the one end portion of the lower thread T is further pulled toward the other side in the peripheral direction of the holder 16, the portion of the lower thread T extended from the flange portions 50B of the small-diameter bobbin 50 is guided to enter below the tip end portion of the inner guide portion 36 by the outer guide portion 38. At this time, the lower thread T is inserted into the inner threading groove portion 32 by the inner guide surface 36A without being caught by the tip end portion of the inner guide portion 36.

When the tip end portion of the one end portion of the lower thread T is further pulled toward the other side in the peripheral direction of the holder 16, the lower thread T extended from the flange portions 50B of the small-diameter bobbin 50 is folded back to the inside in the radial direction by the outer peripheral edge portion of the flange portions 50B. Thus, the lower thread T is inserted between the inner guide portion 36 and the flange portions 50B and moved to the other of the first direction in the other end portion side of the inner threading groove portion 32. When the lower thread located in the inner threading groove portion 32 is reached to the another end portion 32A of the inner threading groove portion 32, the lower thread T is cut by the first blade portion 40B. Consequently, one end portion T1 of the lower thread T is held by the inner guide portion 36 and the flange portions 50B of the small-diameter bobbin 50 (shown in FIG. 4). As described above, the thread cutting process of the lower thread T for winding the lower thread T around the small-diameter bobbin 50 is finished. After the thread cutting process of the lower thread T is finished, when the thread winding motor of the lower thread winding device 10 is driven, the small-diameter bobbin 50 is rotated together with the thread winding shaft 12 and the lower thread is wound around the core portion 50A of the small-diameter bobbin 50.

(Thread Cutting Process of Lower Thread T for Winding Lower Thread T Around Large-Diameter Bobbin 60)

When the lower thread T is wound around the large-diameter bobbin 60 by the lower thread winding device 10, first, same as the above described procedures, one end portion (tip end portion) of the lower thread T extended from a thread bobbin (not-illustrated) of a sewing machine is wound around the core portion 60A of the large-diameter bobbin 60 manually by an operator. Then, the thread cutting process is performed for one end portion of the lower thread T extended from the core portion 60A using the thread cutting mechanism portion 20A.

Specifically, the one end portion of the lower thread T extended from the core portion 60A of the large-diameter bobbin 60 is inserted into the threading groove 30 from the inlet portion 30A of the threading groove 30. More specifically, the portion of the lower thread T extended from an outer peripheral edge portion of the flange portions 60B of the large-diameter bobbin 60 is inserted into the inlet portion 30A of the threading groove 30.

Figure 5B:
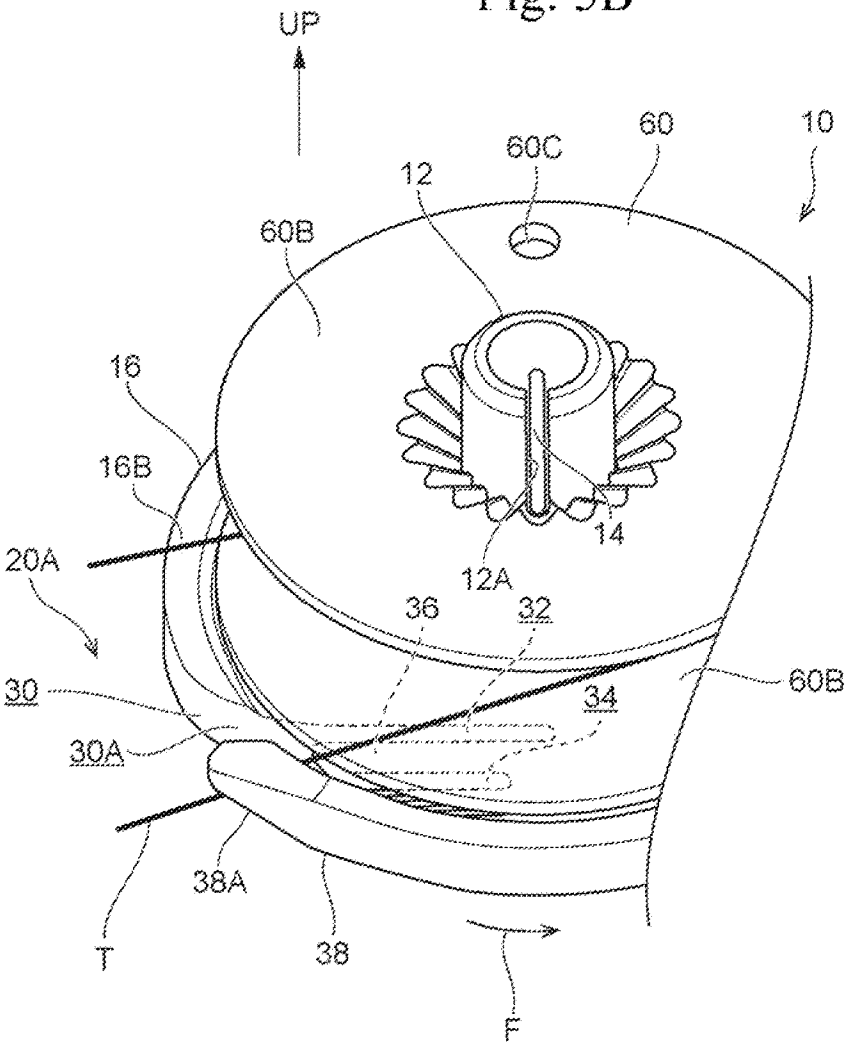
FIG. 5B is a perspective view of the initial state shown in FIG. 5A viewed from another position.
Figure 5A:
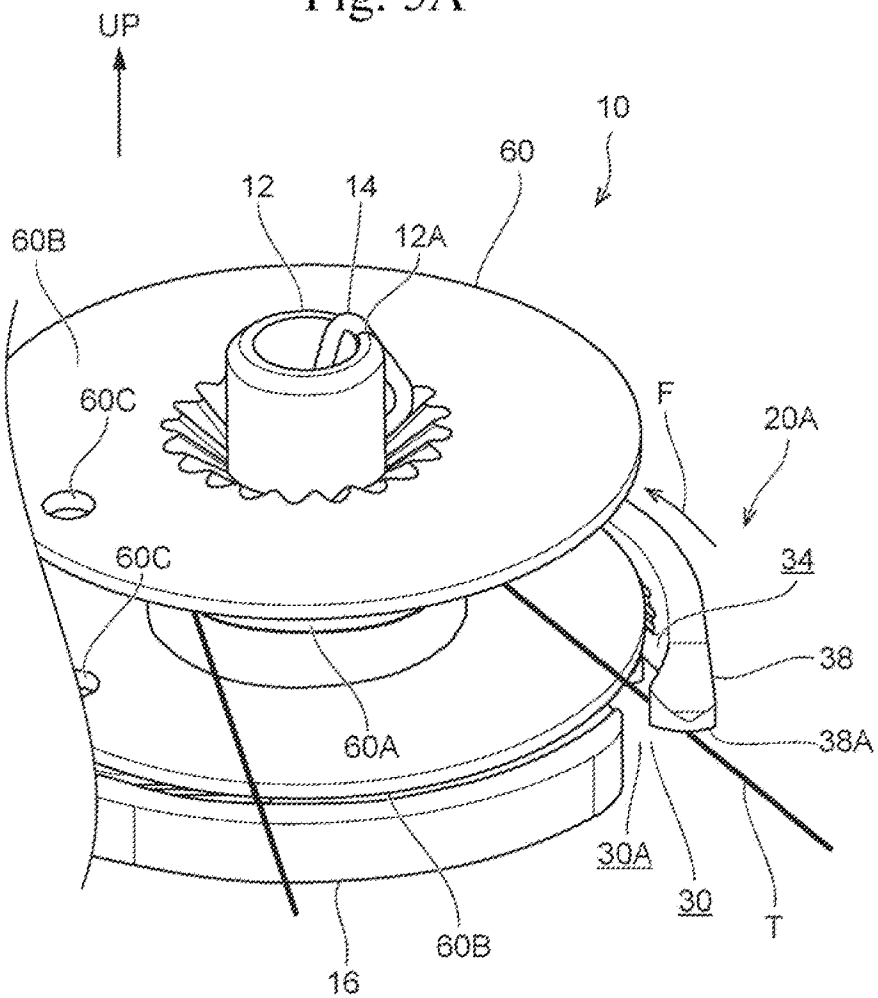
FIG. 5A is a perspective view showing an initial state of a thread cutting process of a lower thread wound around a large-diameter bobbin.
Figure 6:
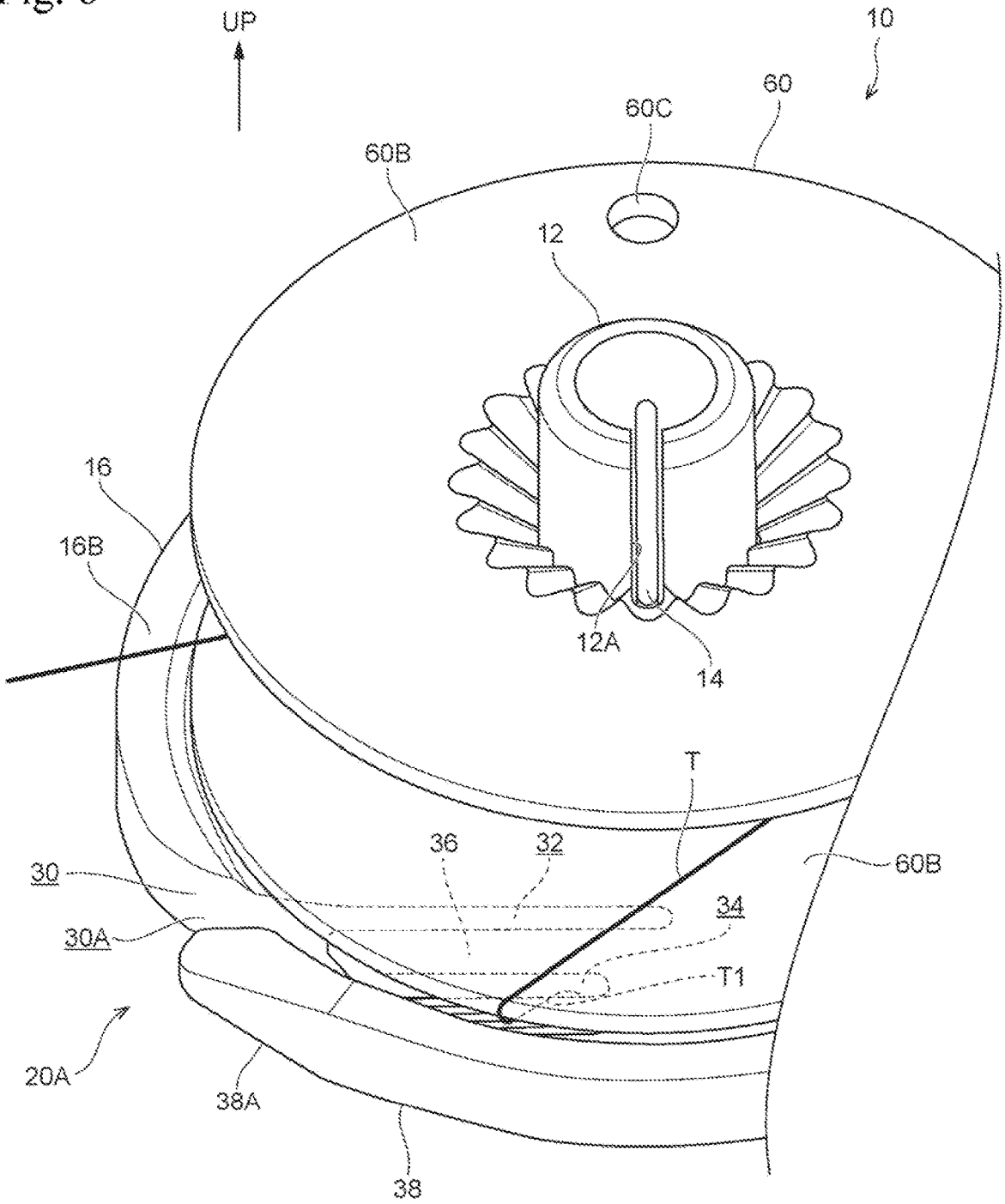
FIG. 6 is a perspective view showing a finished state of the thread cutting process of the lower thread wound around the large-diameter bobbin.

As shown in FIGS. 5A and 5B, the tip end portion of the one end portion of the lower thread T is pulled toward the other side (direction of the arrow mark F in FIGS. 5A and 5B) in the peripheral direction of the holder 16. Thus, the lower thread T extended from the flange portions 60B of the large-diameter bobbin 60 is guided below the tip end portion of the outer guide portion 38 by the outer guide surface 38A of the outer guide portion 38. At this time, the portion of the lower thread T extended from the flange portions 60B of the large-diameter bobbin 60 is inserted into the one end portion of the outer threading groove portion 34.

When the tip end portion of the one end portion of the lower thread T is further pulled toward the other side in the peripheral direction of the holder 16, the portion of the lower thread T extended from the flange portions 60B of the large-diameter bobbin 60 is folded back to the inside in the radial direction by the outer peripheral edge portion of the flange portions 60B. Thus, the lower thread T is inserted between the outer guide portion 38 and the flange portions 60B and moved to the other of the first direction in the other end portion side of the outer threading groove portion 34. When the lower thread located in the outer threading groove portion 34 is reached to the another end portion 34A of the outer threading groove portion 34, the lower thread T is cut by the second blade portion 40C. Consequently, one end portion T1 of the lower thread T is held by the outer guide portion 38 and the flange portions 60B of the large-diameter bobbin 60 (shown in FIG. 6). As described above, the thread cutting process of the lower thread T for winding the lower thread T around the large-diameter bobbin 60 is finished. Same as the above described procedure, after the thread cutting process of the lower thread T is finished, when the lower thread winding device 10 is operated, the lower thread is wound around the core portion 60A of the large-diameter bobbin 60.

As explained above, in the thread cutting mechanism portions 20A, 20B, 20C of the lower thread winding device 10, two groove portions of the inner threading groove portion 32 and the outer threading groove portion 34 are formed on the holder 16. In the inner threading groove portion 32, the one end portion is opened to one of an intersecting direction intersecting with the radial direction of the holder 16 at the outer peripheral portion of the holder 16 and the another end portion 32A is located at the inside in the radial direction of the small-diameter bobbin 50. The outer threading groove portion 34 is located at the outer side of the inner threading groove portion 32 in the radial direction of the holder 16. In the outer threading groove portion 34, the one end is communicated with the inner threading groove portion 32 and located at the outer side of the large-diameter bobbin 60 in the radial direction and the another end portion 34A is located at the inside of the large-diameter bobbin 60 in the radial direction.

Consequently, the thread cutting process of the lower thread T of the small-diameter bobbin 50 can be performed by using the inner threading groove portion 32 while the thread cutting process of the lower thread T of the large-diameter bobbin 60 can be performed by using the outer threading groove portion 34. The positions of the another end portion 32A of the inner threading groove portion 32 and the another end portion 34A of the outer threading groove portion 34 are arbitrarily specified. Thus, the length of the one end portion T1 (end portion extended from the outer peripheral portion of the flange of the bobbin) of the lower thread T after the thread cutting process can be the same between the small-diameter bobbin 50 and the large-diameter bobbin 60. Accordingly, the lower thread winding device 10 of the present embodiment enables to perform the thread cutting process well for the lower thread wound around the bobbins having different outer diameters.

In addition, the first blade portion 40B and the second blade portion 40C are formed by the blade portion 40A of the thread cutting blade 40. Namely, the first blade portion 40B and the second blade portion 40C are formed of a single thread cutting blade 40. Because of this, even when two groove portions (inner threading groove portion 32 and outer threading groove portion 34) are formed on the holder 16 in the thread cutting mechanism portions 20A, 20B, 20C, a blade portion for cutting the lower thread T can be provided on the inner threading groove portion 32 and the outer threading groove portion 34 by the thread cutting blade 40. Accordingly, cost down can be achieved in the lower thread winding device 10.

In addition, the portion between the inner threading groove portion 32 and the outer threading groove portion 34 in the holder 16 is configured as the inner guide portion 36. The tip end portion of the inner guide portion 36 is located at the outer side of the small-diameter bobbin 50 in the radial direction and the inside of the large-diameter bobbin 60 in the radial direction in a plan view. Consequently, during the thread cutting process of the lower thread T wound around the small-diameter bobbin 50, the lower thread T can be guided to the inside of the inner threading groove portion 32 by the inner guide portion 36. On the other hand, during the thread cutting process of the lower thread T wound around the large-diameter bobbin 60, the lower thread T can be prevented from being guided to the inner threading groove portion 32 side.

In addition, the outer side portion of the outer threading groove portion 34 in the radial direction is configured as the outer guide portion 38. During the thread cutting process of the lower thread T wound around the small-diameter bobbin 50, the lower thread T entered below the outer guide portion 38 is guided to inside of the inner threading groove portion 32 by the outer guide portion 38. Accordingly, the operability can be improved when performing the thread cutting process of the lower thread T.

In addition, the outer guide surface 38A is formed on the lower surface of the outer guide portion 38. The outer guide surface 38A is inclined upward toward the tip end portion of the outer guide portion 38. Accordingly, during the thread cutting process of the lower thread T wound around the small-diameter bobbin 50 and the large-diameter bobbin 60, the lower thread T can be guided to below the outer guide portion 38 by the outer guide surface 38A. In addition, the inner guide surface 36A is formed on the lower surface of the inner guide portion 36. The inner guide surface 36A is inclined upward toward the tip end portion of the inner guide portion 36. Accordingly, during the thread cutting process of the lower thread T wound around the small-diameter bobbin 50 and the large-diameter bobbin 60, the lower thread T can be inserted into the inner threading groove portion 32 while the lower thread T is prevented from being caught by the tip end portion of the inner guide portion 36 by the inner guide portion 36. As described above, the operability can be improved when performing the thread cutting process of the lower thread T.

Although the length of the outer threading groove portion 34 is specified to be shorter than the length of the inner threading groove portion 32 in the present embodiment, it is also possible to specify the length of the outer threading groove portion 34 longer than the length of the inner threading groove portion 32 in accordance with the outer diameters of the small-diameter bobbin 50 and the large-diameter bobbin 60.

Although two groove portions (inner threading groove portion 32 and outer threading groove portion 34) are formed in the thread cutting mechanism portions 20A, 20B, 20C in the present embodiment, it is also possible to form three or more groove portions in the thread cutting mechanism portions 20A, 20B, 20C. Namely, the lower thread winding device 10 can be configured so that the lower thread can be wound around the bobbins having three or more different outer diameters.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A lower thread winding device, comprising:

a thread winding shaft to which a small-diameter bobbin and a large-diameter bobbin having a larger diameter than the small-diameter bobbin can be attached;

a holder which is configured to be integrally rotated with the thread winding shaft, the holder being formed in a disk shape so that a plate thickness direction of the holder is directed in an axial direction of the thread winding shaft, the small-diameter bobbin or the large-diameter bobbin attached to the thread winding shaft being configured to be placed on the holder;

an inner groove portion which is formed on the holder so as to be extended in an intersecting direction intersecting with a radial direction of the holder when viewed from the axial direction, one end portion of the inner groove portion being opened to one of the intersecting direction at an outer peripheral portion of the holder, another end portion of the inner groove portion being located at an inner side of the small-diameter bobbin attached to the thread winding shaft in the radial direction;

an outer groove portion which is formed on the holder so as to be extended in the intersecting direction at an outer side of the inner groove portion in the radial direction of the holder, one end portion of the outer groove portion being curved toward the inner groove portion, communicated with the inner groove portion and located at the outer side of the large-diameter bobbin attached to the thread winding shaft in the radial direction, another end portion of the outer groove portion being located at the inner side of the large-diameter bobbin in the radial direction;

a first blade portion provided on the holder so as to be exposed to the another end portion of the inner groove portion; and a second blade portion provided on the holder so as to be exposed to the another end portion of the outer groove portion.

2. The lower thread winding device according to claim 1, wherein the first blade portion and the second blade portion are formed of a single blade member.

3. The lower thread winding device according to claim 1, wherein the holder includes an inner guide portion for partitioning the inner groove portion and the outer groove portion from each other, the inner guide portion is protruded from the holder toward the one of the intersecting direction, and a tip end portion of the inner guide portion is located at the outer side of the small-diameter bobbin attached to the thread winding shaft in the radial direction and located at the inner side of the large-diameter bobbin in the radial direction when viewed from the axial direction.

4. The lower thread winding device according to claim 3, wherein the holder includes an outer guide portion located at the outer side of the outer groove portion in the radial direction of the holder so that the outer guide portion forms the outer peripheral portion of the holder, the outer guide portion is extended from the holder toward the one of the intersecting direction, and a thread wound around the small-diameter bobbin and entered below the outer guide portion is guided by the inner groove portion.

5. The lower thread winding device according to claim 4, wherein a lower surface of the tip end portion of the inner guide portion is provided with an inner guide surface inclined upward toward the tip end portion of the inner guide portion, and the lower surface of the tip end portion of the outer guide portion is provided with an outer guide surface inclined upward toward the tip end portion of the outer guide portion.

* * * * *